US006050604A

United States Patent [19]

Ossiatzky

[11] Patent Number: 6,050,604

[45] Date of Patent: Apr. 18, 2000

[54] COLORING BOOK WITH POP-UP FIGURES

[75] Inventor: Ossiatzky, Jakarta, Indonesia

[73] Assignee: Pt. Pabrik Kertas Tjiwi Kimia Tkk., Indonesia

[21] Appl. No.: 09/231,921

[22] Filed: Jan. 14, 1999

[51] Int. Cl.[7] ..... B42D 15/00

[52] U.S. Cl. ..... 283/63.1; 283/45; 283/49; 283/117; 40/124.08

[58] Field of Search ..... 281/15.1, 22, 38, 281/33; 283/45, 46, 49, 63.1, 116, 117; 40/124.1, 124.08; 446/148

[56] References Cited

U.S. PATENT DOCUMENTS

| | | | |
|---|---|---|---|
| D. 391,988 | 3/1998 | Gayda | D19/29 |
| 1,411,022 | 3/1922 | Heidenreich . | |
| 1,685,571 | 9/1928 | Meller . | |
| 1,687,875 | 10/1928 | Meller . | |
| 1,694,551 | 12/1928 | Meller . | |
| 1,705,116 | 3/1929 | Howland . | |
| 1,992,618 | 2/1935 | Jeffreys | 281/38 |
| 2,282,280 | 5/1942 | Yogg | 40/124.1 |
| 2,544,783 | 3/1951 | Freedman et al. | 40/126 |
| 3,228,139 | 1/1966 | Lohnes | 446/148 |
| 3,433,485 | 3/1969 | Renn et al. | 273/157 |
| 4,349,973 | 9/1982 | Penick et al. | 40/124.1 |
| 5,010,669 | 4/1991 | Moran | 40/539 |
| 5,022,681 | 6/1991 | Penick | 281/15.11 |
| 5,293,706 | 3/1994 | Wood | 446/148 X |
| 5,472,240 | 12/1995 | Davies | 283/116 |
| 5,933,989 | 8/1999 | Volkent et al. | 40/124.08 |

*Primary Examiner*—Willmon Fridie, Jr.
*Attorney, Agent, or Firm*—Hayes, Soloway, Hennessey, Grossman & Hage, P.C.

[57] ABSTRACT

A coloring book is formed of a plurality of sheets of card stock removably affixed along one edge to the book binding. An image is printed on the face of the sheet, and a die cut outline of the image circumscribes a portion of the image to a midpoint of the sheet. Parallel fold lines are provided adjacent the top and bottom edges of the sheet, and a third discontinuous fold line is provided midpoint of the sheet from the side edges of the sheet to the die cut image. The coloring book is designed so that the individual sheets may be removed, e.g. after coloring, and folded to form a stand with the colored picture standing upright.

11 Claims, 4 Drawing Sheets

COLORING BOOK WITH POP-UP FIGURES

BACKGROUND OF THE INVENTION

1. Field of the Invention

The present invention is directed to books, and more particularly to bound coloring books and the like having pop-up figures.

2. Description of the Prior Art

For many years coloring books have been printed on thin paper stock with a plurality of pages bound or stapled together to form a book. While bound coloring books provide substantial play and activity value for children, and also help develop fine motor skills, creativity and image recognition, conventional thin stock bound coloring books do not readily lend themselves to subsequent display of the child's work. It is, of course, possible to tear or remove individual sheets from the coloring book either before or after the sheets are colored; however, often the sheets are damaged during removal. Also, because the paper stock is thin, the sheets must then be taped, or otherwise affixed to a rigid surface in order to display the child's work.

SUMMARY OF THE INVENTION

The present invention provides a coloring book which overcomes the aforesaid and other disadvantages of the prior art. More particularly, in accordance with the present invention, a coloring book comprises a plurality of pages printed on card stock, each containing an outline of a figure or scene to be colored. Each sheet includes three parallel fold or crease lines, including a center line by which the sheet may be folded in half, and two fold or crease lines adjacent the top and bottom edges of the sheets. An outline of a figure or scene to be colored, and other background outlines are printed on the card. The top half of the outline of the figure or scene is die cut or formed through each sheet to the center fold line. At least one, and preferably a pair of tabs or slots are die cut or formed through each sheet adjacent one of the top and/or bottom edges, for insertion or locking with an appropriately sized and aligned slot or tab formed in the opposite edge. Each sheet is removably bound to the coloring book along one edge thereof, by means of, for example, a hot melt adhesive, or the like, which permits the removal of each individual sheet without disturbing the other sheets and without damaging the sheet being removed.

BRIEF DESCRIPTION OF THE DRAWINGS

Further features and advantages of the present invention may be seen from the following detailed description, taken in conjunction with the accompanying drawings wherein:

FIG. 1 is a front perspective view of a coloring book made in accordance with the present invention partially colored in;

DETAILED DESCRIPTION OF THE INVENTION

Figure 1:
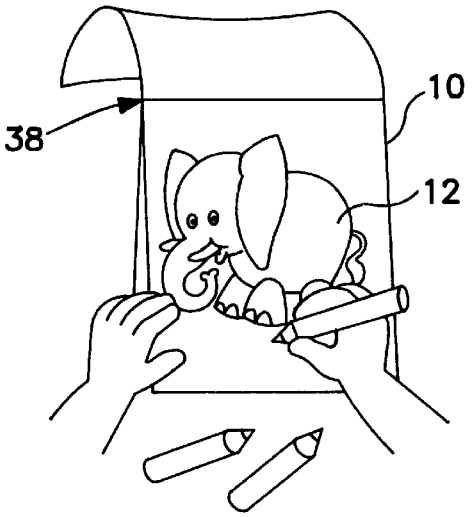

Referring to the drawings, the coloring book made in accordance with the present invention comprises a plurality of initially flat, planar sheets 10 of card stock having an outline of a FIG. 12 and background images 14 printed thereon.

The paper card stock includes a pair of long lateral edges 16, 18, and top and bottom edges 20 and 22, respectively. Parallel crease or fold lines 24, 26 are formed in the card stock spaced a short distance from the top and bottom edges 20, 22. A third crease or fold line comprising two aligned segments 28A, 28B running parallel to fold lines 20, 22, is formed midway between top and bottom edges 20, 22. Fold lines 28A, 28B run from the side edges 16 and 18 to a die cut line 30 formed through the card stock sheet just to the outside of the figure outline 12. Crease or fold lines 24, 26 and 28A/28B may comprise microperforated lines, embossed impression lines or the like, forming straight lines of weakness to guide folding along the said lines as will be described in detail hereinafter.

The top half outline of the FIG. 12 is die cut through at die cut line 30 from the midpoint line of the card so that when the card is subsequently folded over along lines 28A, 28B, the top half of the FIG. 12 stands up and extends beyond the fold line.

Figure 4:
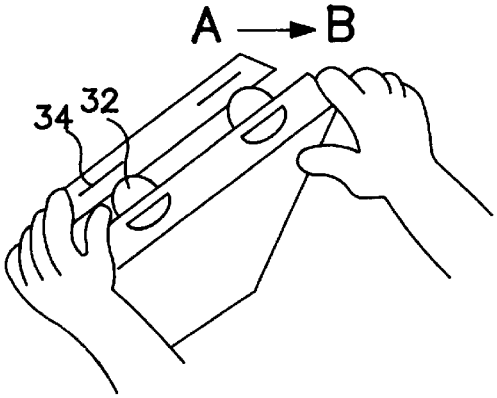
FIG. 4 is a perspective view, taken from the bottom, and showing the sheet in the process of being assembled.
Figure 5:
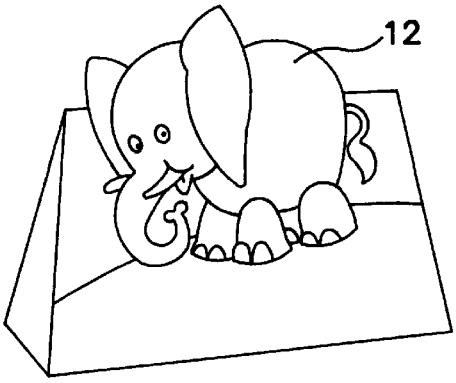
FIG. 5 is a front perspective view of an assembled colored sheet in accordance with the present invention.
Figure 1A:
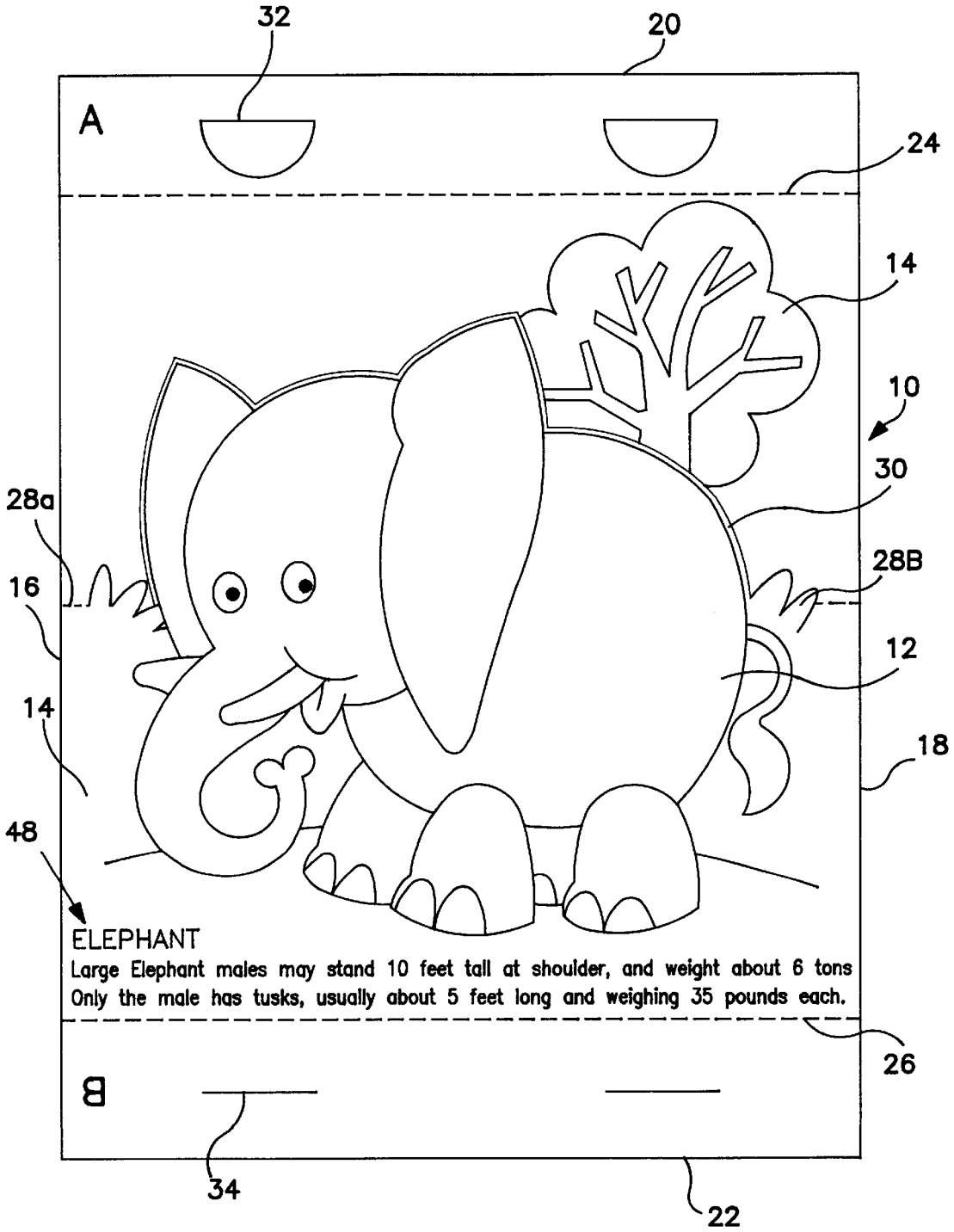
FIG. 1A is a top plan view of a single sheet from the coloring book of FIG. 1.

One or a pair of tabs 32 are die cut adjacent one of the top or bottom edges, inboard of the respective fold lines, while one or a pair of slots 34 is provided adjacent the other edge so that the top and bottom edges 20, 22 may be folded over aligning edges A and B, and locked in place so that the card may then be stood up in the form of a triangle, and the colored art displayed. (See FIGS. 4 and 5).

Figure 2:
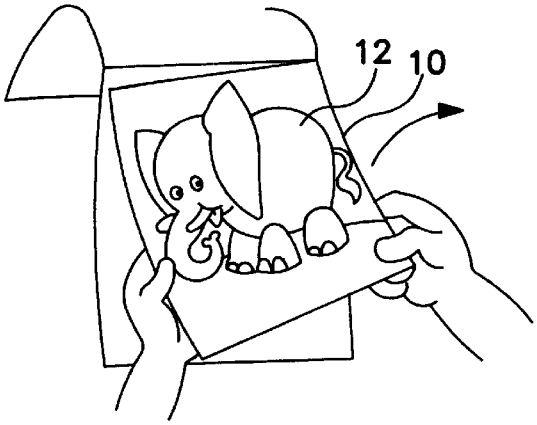
FIG. 2 is a front perspective view of the coloring book of FIG. 1, after the picture is fully colored.
Figure 3:
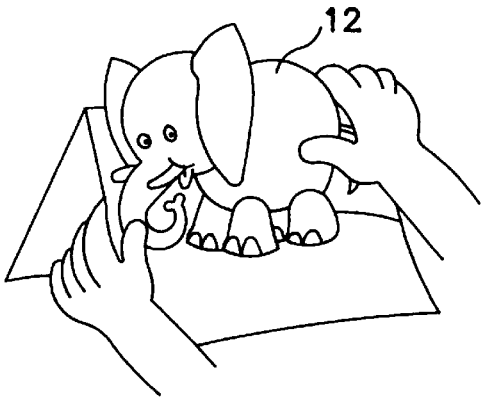
FIG. 3 is a perspective view of an individual colored sheet in the process of being folded.

Sheet 10 is removably affixed adjacent its top edge 20 to the coloring book binding as, for example, by means of a hot melt adhesive 38 or the like, which permits the individual sheet to be readily removed once the child is through coloring. (See FIG. 2). Alternatively, a perforated tear line may be provided adjacent the top edge of sheet 10 to facilitate removal of the individual sheets.

Figure 6:
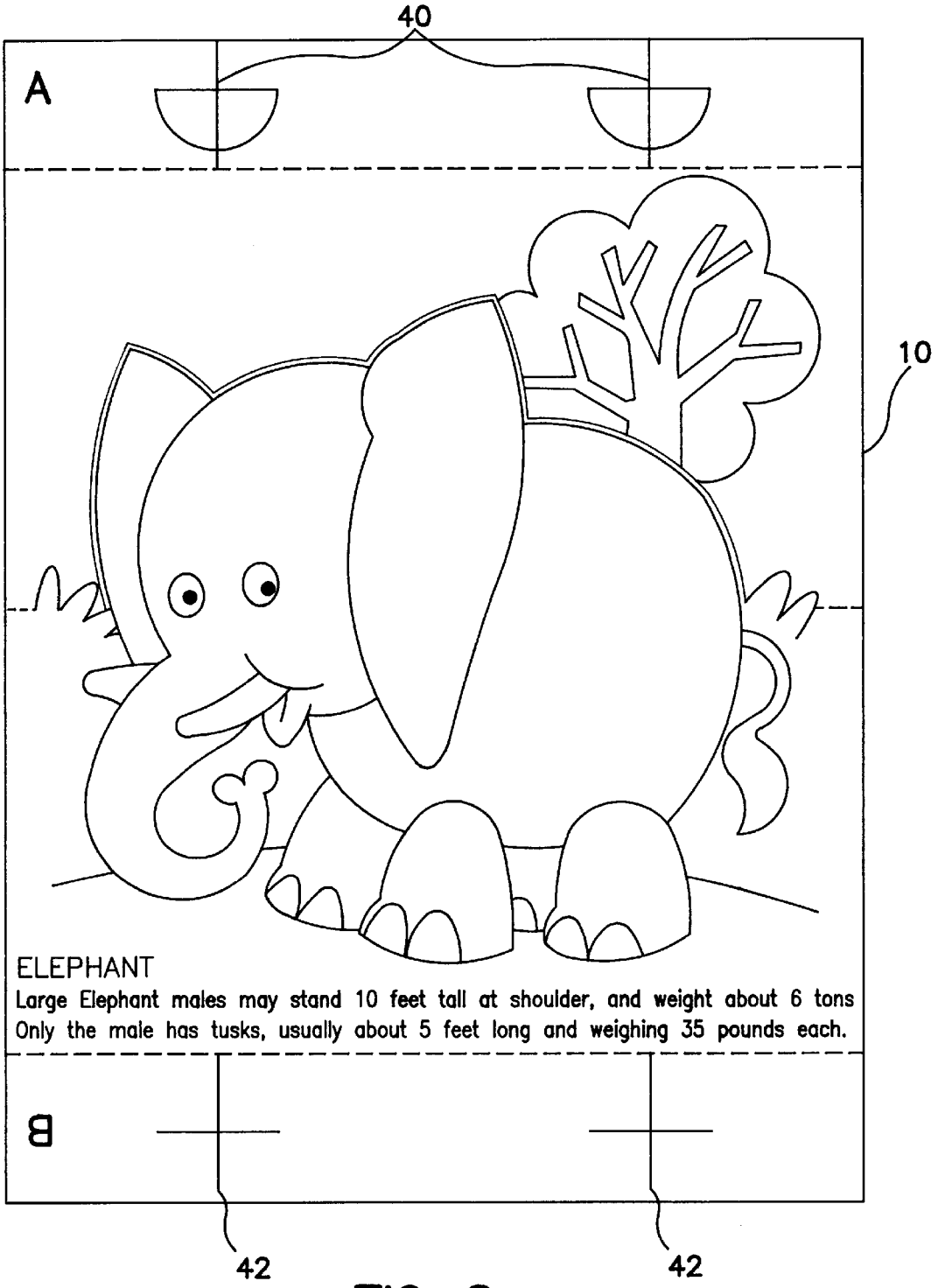
FIG. 6 is a view, similar to FIG. 1A, and illustrating an alternative embodiment of the invention.
Figure 7:
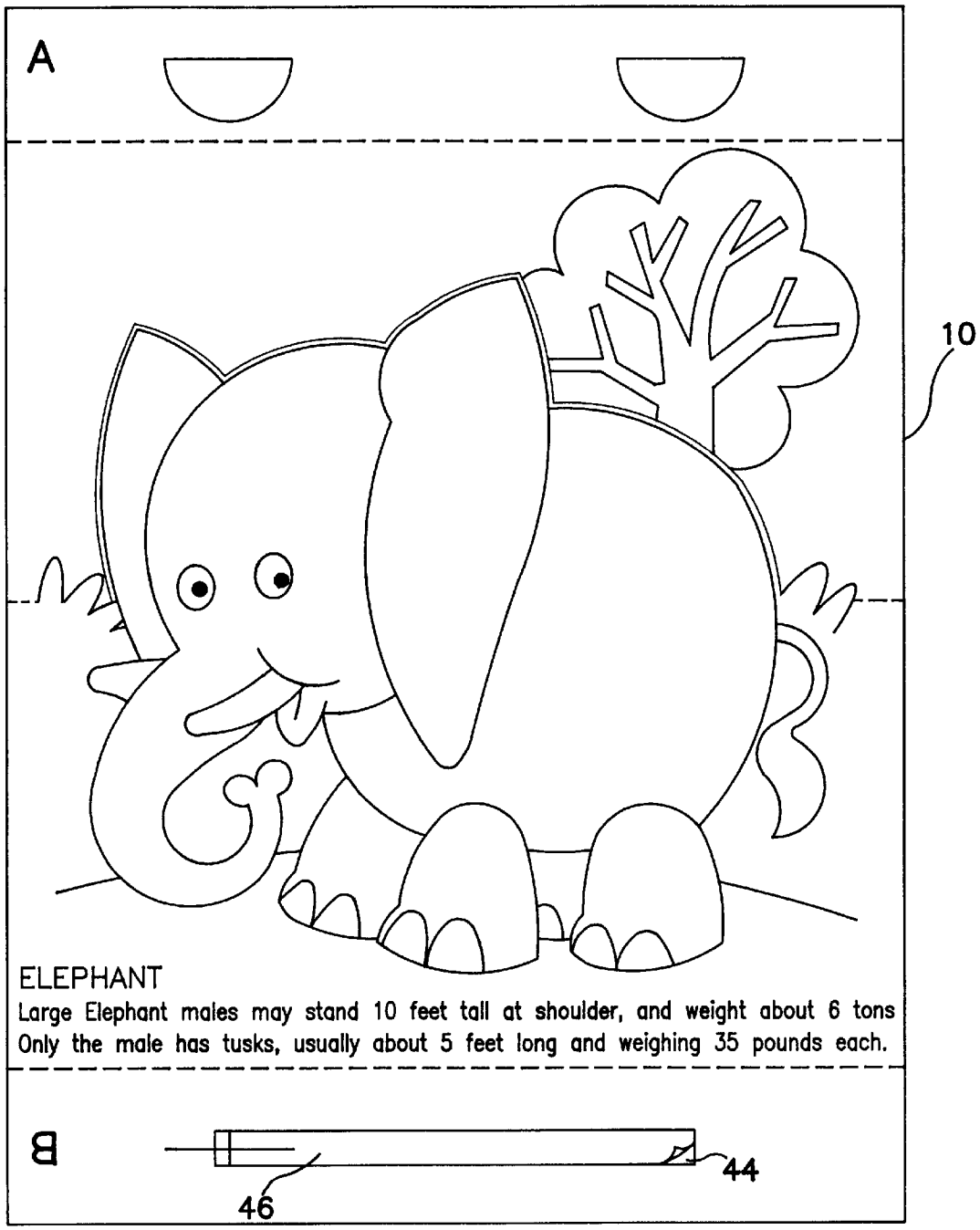
FIG. 7 is a view similar to FIG. 1A, and illustrating yet another alternative embodiment of the invention.

The invention is susceptible to modification. For example, as seen in FIG. 6, tab 32 and slots 34 may be replaced with cooperating slots 40, 42 for locking the top and bottom fold over edges together. Alternatively, as seen in FIG. 7, a strip of an adhesive such as a pressure sensitive adhesive 44 or the like may be supplied to the back of one of the marginal fold over edges, covered by a removable release film 46, for affixing the edges together to form the stand.

Other changes may be made without departing from the spirit and scope of the invention. For example, descriptive material such as animal facts may be printed on each sheet, e.g. at 48, to add to educational value. Also, the "pop-up" construction of the present invention advantageously may be employed with other constructions. For example, preprinted card stock may be interleaved into a storybook or lesson book. Upon mastery of the preceding section, the child may then be permitted to remove the card and fold same to provide a pop-up figure as a "reward" for successfully mastering that section of the book. Yet other changes may be made as well.

I claim:

1. A pop-up book comprising a plurality of sheets, printed on card stock, and removably bound to a book binding along one edge thereof;

said sheet having a top edge, a bottom edge and a midpoint separating a top half and a bottom half;

an image formed on said sheet, and cut at least partly through the top half of said sheet stock to the midpoint line;

said card further comprising three parallel fold lines, a first and a second fold line formed adjacent the respective top and bottom edges thereof, and a third fold line comprising two aligned segments running from side edges of said sheet to said image edge cut line, wherein each sheet, upon removal from the book, may be folded in the form of a triangle, stood up and the image displayed.

2. In a book according to claim 1, and further including locking means formed adjacent the page top and bottom edges for locking the edges together.

3. In a book according to claim 2, wherein the locking means comprise cooperating tabs and slots.

4. In a book according to claim 2, wherein the locking means comprise cooperating slots.

5. In a book according to claim 2, wherein the locking means comprise adhesive means.

6. In a book according to claim 5, wherein the adhesive means comprises a pressure sensitive adhesive, and further including a removable release film covering said adhesive.

7. In a book according to claim 1, wherein said sheets are affixed to a binding along their top edge by a hot melt adhesive.

8. In a book according to claim 1, wherein said image comprises an outline image designed for coloring.

9. In a book according to claim 1, and further including descriptive information printed on said sheet.

10. In a book according to claim 1, wherein said fold lines comprise embossed lines.

11. In a book according to claim 1, wherein said fold lines comprise microperforated lines.

* * * * *